US010707593B2

(12) United States Patent
Wang

(10) Patent No.: US 10,707,593 B2
(45) Date of Patent: Jul. 7, 2020

(54) TERMINAL ASSEMBLY FOR ELECTRICAL DEVICE AND ELECTRICAL DEVICE

(71) Applicant: Schneider Electric (Australia) Pty Ltd, Macquarie Park (AU)

(72) Inventor: Yonggang Wang, Shenzhen (CN)

(73) Assignee: Schneider Electric (Australia) Pty Ltd, Macquarie Park (AU)

( * ) Notice: Subject to any disclaimer, the term of this patent is extended or adjusted under 35 U.S.C. 154(b) by 0 days.

(21) Appl. No.: 16/519,495

(22) Filed: Jul. 23, 2019

(65) Prior Publication Data

US 2020/0036114 A1 Jan. 30, 2020

(30) Foreign Application Priority Data

Jul. 25, 2018 (CN) ..... 2018 2 1185798 U

(51) Int. Cl.
*H01R 9/18* (2006.01)
*H01R 4/30* (2006.01)

(52) U.S. Cl.
CPC ..... *H01R 9/18* (2013.01); *H01R 4/30* (2013.01)

(58) Field of Classification Search
None
See application file for complete search history.

(56) References Cited

U.S. PATENT DOCUMENTS 1,888,384 A * 11/1932 Hyde ..... H01R 4/30 439/809
3,901,577 A * 8/1975 Philibert ..... H01R 4/643 439/804
3,988,052 A * 10/1976 Mooney ..... H01R 4/46 439/804
6,040,525 A * 3/2000 Chauquet ..... H01R 4/363 174/40 CC
6,976,857 B1 * 12/2005 Shukla ..... H01R 4/46 439/100
7,537,494 B1 * 5/2009 Umlauf ..... H01R 4/36 439/798
7,922,546 B1 * 4/2011 Smith ..... H01R 4/646 439/792
9,926,957 B2 * 3/2018 Zhang ..... F16B 2/14
2004/0092142 A1 * 5/2004 Clark ..... H01R 4/36 439/100
2015/0101154 A1 * 4/2015 Wottrich ..... F16B 37/02 24/326

* cited by examiner

*Primary Examiner* — Harshad C Patel
(74) *Attorney, Agent, or Firm* — Locke Lord LLP

(57) ABSTRACT

Embodiments of the present disclosure provide a terminal assembly for an electrical device and an electrical device comprising the same. The terminal assembly comprises: a first terminal comprising a terminal seat and a screw in a threaded connection with the terminal seat, a cavity for receiving a wire being formed in the terminal seat; and a second terminal, comprising: a body provided with a hook thereon, wherein the first terminal is adapted to be connected with the second terminal via the hook; and a clamping arm with one end connected with the body and the other end being a free end adapted to cooperate with the body for clamping the wire. Such terminal assembly can provide two different types of terminals to adapt to criteria in different countries and areas, and thus can broaden the application range of the product.

12 Claims, 4 Drawing Sheets

TERMINAL ASSEMBLY FOR ELECTRICAL DEVICE AND ELECTRICAL DEVICE

FIELD

Embodiments of the present disclosure generally relate to the field of electrical device, and more specifically, to a terminal assembly for an electrical device and an electrical device comprising the same.

BACKGROUND

In an electrical device, terminals are typically employed for connecting and securing a wire. At the end of the wire for connection, an insulation cover is peeled off to expose a metal wire therein, for example, a copper wire. The terminal is connected with the exposed metal wire, to implement electrically conductive connection between the terminal and the wire.

Currently, there are generally two types of terminals for electrical devices, i.e., a threaded terminal and an unthreaded terminal. The threaded terminal is mainly applied to multi-core wire connection, while the unthreaded terminal is mainly used for single core wire connection. Since criteria and standards for a terminal of an electrical device vary according to specific countries and areas, terminals of respective types are required in the electrical device to satisfy the variety of criteria and standards.

SUMMARY

The existing electrical device typically utilizes a terminal of only one of the two types, which limits the application range of the electrical device and affects their promotion. In addition, in order to adapt to different criteria and standards, dedicated molds are needed to produce the terminals of the respective types, thereby incurring further investment in molds and increasing the production costs.

The embodiments of the present disclosure provide a terminal assembly for an electrical device and an electrical device comprising the same, to solve or at least partly solve the above problem(s) in the existing terminal for the electrical device.

In one aspect of the present disclosure, there is provided a terminal assembly for an electrical device. The terminal assembly comprises: a first terminal comprising a terminal seat and a screw in a threaded connection with the terminal seat, a cavity for receiving a wire being formed in the terminal seat; and a second terminal, comprising: a body provided with a hook thereon, wherein the first terminal is adapted to be connected with the second terminal via the hook; and a clamping arm with one end connected with the body and the other end being a free end adapted to cooperate with the body for clamping the wire.

The terminal assembly according to embodiments of the present disclosure, provided with the first terminal and the second terminal of two different types, can satisfy requirements on the electrical terminal in different countries and areas, and hence broaden the application range of the product. Through cooperation of the terminal seat with the screw, the first terminal is adapted to connect with a multi-core wire; while through the body and the clamping arm, the second terminal is adapted to connect with a single core wire.

In some embodiments, the terminal seat of the first terminal comprises a first wall and a second wall opposite to each other, and wherein the first wall is provided with a threaded hole thereon for receiving a screw, and wherein the second wall is adapted to be connected with the second terminal via a hook of the second terminal. In those embodiments, through cooperation of the terminal seat with the screw, the first terminal is adapted to connect with the multi-core wire. In the meantime, the first terminal is connected with the hook of the second terminal via the second wall.

In some embodiments, the body of the second terminal comprises a connection board, with one end of the connection board provided with a first arm and the other end of the connection board provided with a second arm, the first arm and the second arm extending in parallel with each other along a direction perpendicular to the connection board. In those embodiments, the first arm or the second arm on the body may cooperate with the clamping arm, thereby securing the wire therebetween.

In some embodiments, the hook is provided on the first arm. In those embodiments, by providing the hook on the first arm, it is accomplished that the first terminal is connected with the first arm of the second terminal.

In some embodiments, a gap for engaging the first terminal is formed between the hook and the first arm. In those embodiments, the second wall of the first terminal can be inserted into the gap, thereby enabling a connection between the first terminal and the second terminal.

In some embodiments, the clamping arm is connected with the first arm, and the second arm is provided with a curved portion thereon for cooperating with the clamping arm to clamp the wire. In those embodiments, the curved portion is provided on the second arm, and the curved portion cooperates with the clamping arm, thereby implementing clamping and securing of the wire.

In some embodiments, the clamping arm is connected with the second arm, and the first arm is provided with a curved portion thereon for cooperating with the clamping arm to clamp the wire. In those embodiments, the curved portion is provided on the first arm, and the curved portion cooperates with the clamping arm, thereby implementing clamping and securing of the wire.

In some embodiments, a recess for allowing the wire to pass through is provided on the connection board. In those embodiments, a recess is provided on the connection board, and the wire can pass through the recess, thereby facilitating the connection between the wire and the second terminal.

In some embodiments, the clamping arm is a resilient arm. In those embodiments, through cooperation between the resilient clamping arm and the body of the second terminal, the wire can be clamped and secured reliably.

In some embodiments, the clamping arm includes two clamping arms extending in parallel with each other. In those embodiments, the clamping arm is split into two arms extending in parallel with each other, to facilitate deformation of the clamping arm and thus to adapt to clamp two wires of different thickness.

In some embodiments, the second terminal includes a current-carrying component. In those embodiments, the second terminal also has the function of carrying current and connecting with the wire, to make the entire structure of the terminal assembly more compact.

In a further aspect of the present disclosure, an electrical device is provided. The electrical device includes the above terminal assembly.

It would be appreciated that the summary of the utility model is not intended to identify key features or essential features of the embodiments of the present disclosure, nor is it intended to be used to limit the scope of the present disclosure. Through the following description, other features of the present disclosure will become more apparent.

BRIEF DESCRIPTION OF THE DRAWINGS

Through the following detailed description with reference to the accompanying drawings, the above and other objectives, features, and advantages of example embodiments of the present disclosure will become more apparent. Several example embodiments of the present disclosure will be illustrated by way of example but not limitation in the drawings in which.

Throughout the drawings, the same or similar reference symbols refer to the same or similar elements.

DETAILED DESCRIPTION OF EMBODIMENTS

Figure 1:
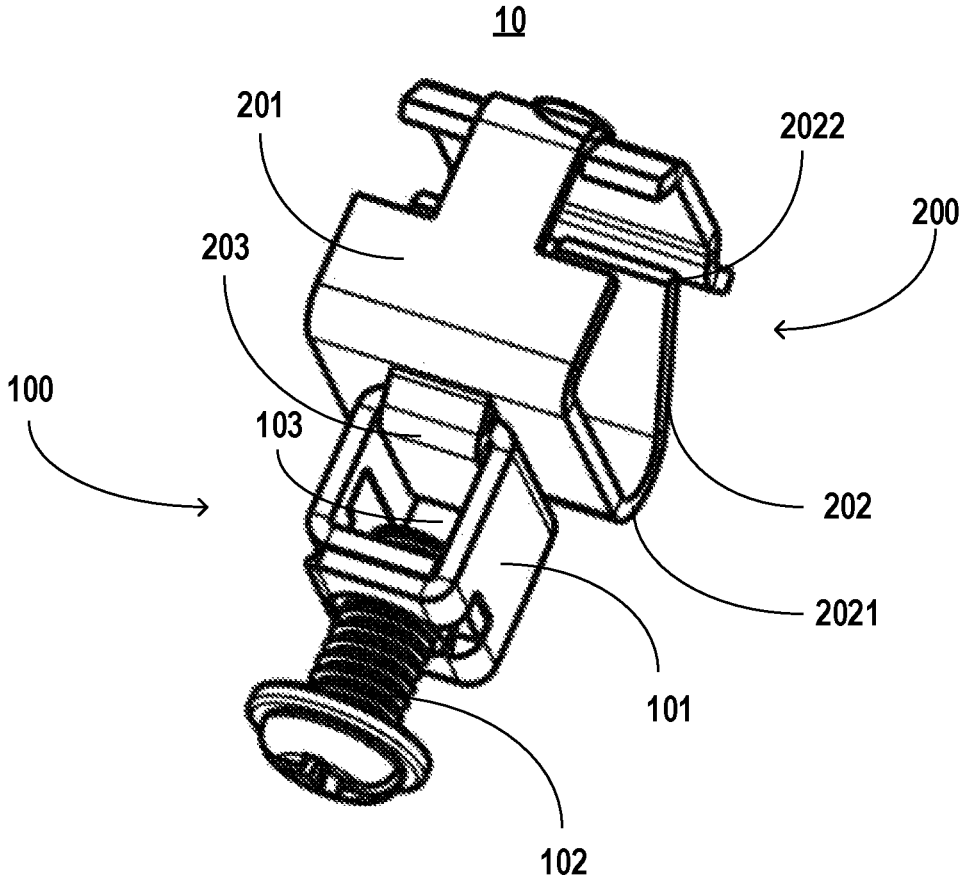
FIG. 1 illustrates a perspective view of a terminal assembly according to embodiments of the present disclosure.

Principles of the present disclosure will now be described with reference to various example embodiments illustrated in the drawings. It should be appreciated that description of those embodiments is merely to enable those skilled in the art to better understand and further implement the present disclosure and is not intended for limiting the scope disclosed herein in any manner. It would be appreciated that the same or similar reference symbols may be employed, if possible, and the same or similar reference symbols represent the same or similar functions. Those skilled in the art would readily envision that, in the following description, alternative embodiments of the structure and method can be used without departing from principles of the present disclosure as described herein.

As introduced briefly above, the inventors have noticed that the existing electrical device typically utilizes only one of the two types of terminal, i.e., a threaded terminal or an unthreaded terminal. However, criteria and standards on terminals for electrical devices vary in different countries and areas. The electrical device with a single type of terminal will encounter restrictions when entering the markets of different countries and areas, thereby affecting product's promotion. In addition, in order to make the terminal of the electrical device satisfy different requirements, dedicated molds are required to produce terminals of the respective types, incurring increased investment in molds and increasing the production costs.

The embodiments of the present disclosure provide a terminal assembly, including a first terminal and a second terminal which pertain to the two different types, respectively. Such a terminal assembly can satisfy the requirements on the terminal in different countries and areas, and hence extend the application range of the product. In the meantime, the costs in relation to molds may be reduced. Referring to FIGS. 1-4, some example embodiments will now be described.

It would be appreciated that the spirits and principles of the present disclosure will be described below, using a terminal having an approximate cubic frame as an example to which the scope of the present disclosure however is not confined. Given the teaching of the present disclosure, those skilled in the art would envisage other shapes of terminals. Moreover, the terminal according to the embodiments of the present disclosure is applicable to various devices in need of electrical connection.

Figure 2:
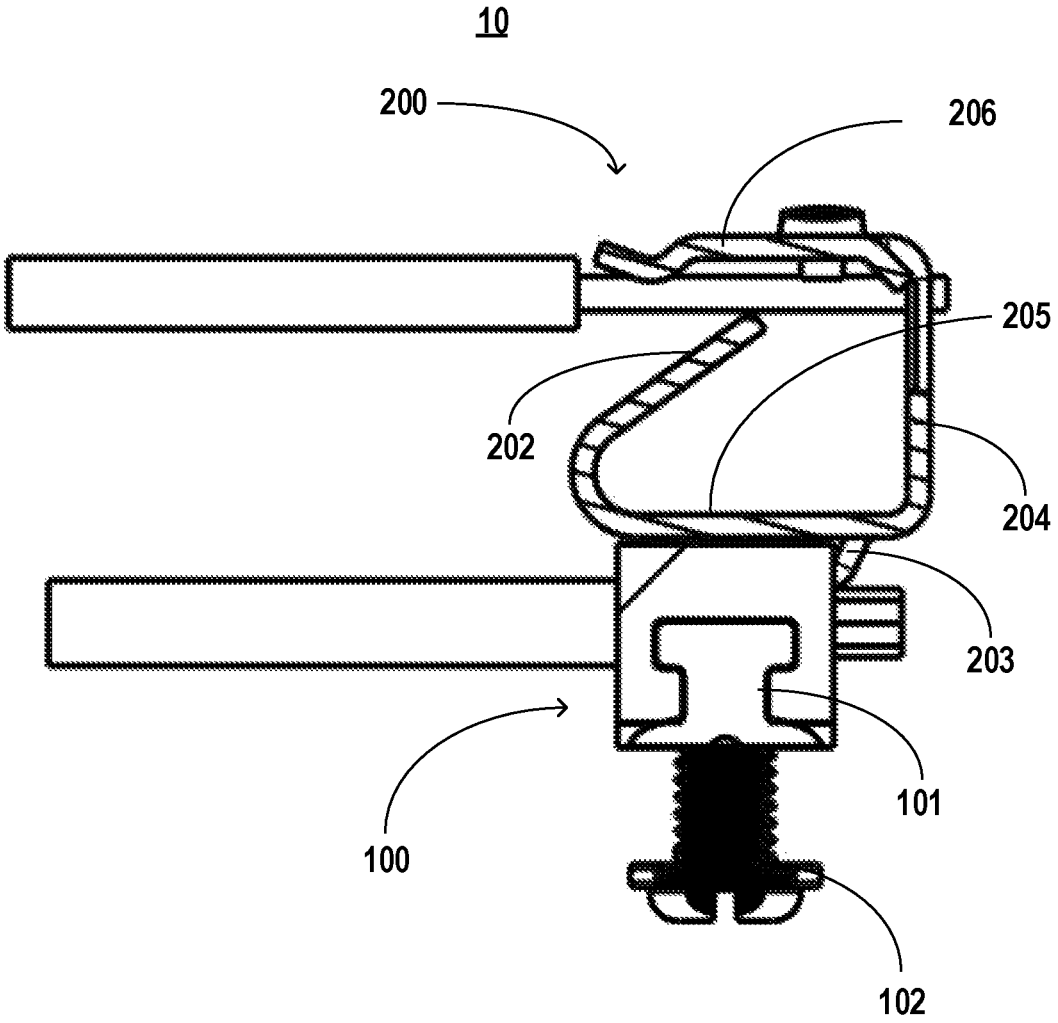
FIG. 2 illustrates a sectional view of a terminal assembly according to embodiments of the present disclosure.

FIG. 1 illustrates a perspective view of a terminal assembly 10 according to embodiments of the present disclosure; and FIG. 2 illustrates a sectional view of the terminal assembly 10 according to embodiments of the present disclosure.

As shown in FIGS. 1 and 2, the terminal assembly 10 according to embodiments of the present disclosure generally comprises a first terminal 100 and a second terminal 200.

The first terminal 100 includes a terminal seat 101 and a screw 102 in threaded connection with the terminal seat 101. A cavity 103 for receiving a wire is provided in the terminal seat 101.

The second terminal 200 includes a body 201 and a clamping arm 202. The body 201 is provided with a hook 203 thereon, through which the first terminal 100 is connected with the second terminal 200. An end 2021 of the clamping arm 202 is connected with the body 201, and the other end is a free end 2022 which is adapted to cooperate with the body 201 to clamp the wire.

In this way, the first terminal 100 including the screw 102 can be combined with the second terminal 200 free of threads, such that the terminal assembly 10 can include two different types of terminals simultaneously. Such terminal assembly 10 can satisfy requirements on terminal types in different countries and areas, thereby broadening the application area of the product. In the meantime, the costs in relation to molds may be reduced.

Figure 3:
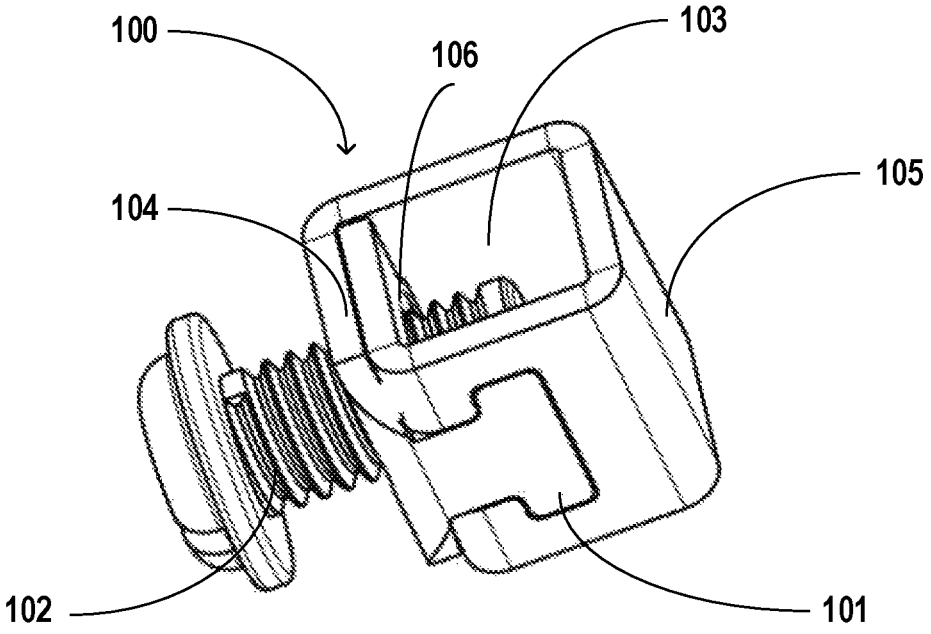
FIG. 3 illustrates a perspective view of a first terminal of a terminal assembly according to embodiments of the present disclosure.

In some embodiments, for example, referring to FIG. 3, the first terminal 100 may include a terminal seat 101 substantially formed in a frame shape, in which a cavity 103 for receiving a wire is formed. In particular, the terminal seat 101 includes a first wall 104 and an opposing second wall 105.

The first wall 104 is provided thereon with a threaded hole 106 for receiving the screw 102. The screw 102 is connected with the terminal seat 101 via the threaded hole 106, and extends into the cavity 103. Therefore, a wire end may be disposed in the cavity 103, and the wire may be clamped and secured via the cooperation between the screw 102 and the second wall 105 of the terminal seat 101.

The shape of the second wall 105 may be adapted to be connected with the second terminal 200 via the hook 203 of the second terminal 200. As such, the first terminal 100 is connected with the second terminal 200 via the second wall 105, thereby forming the terminal assembly 10 according to the present disclosure.

Figure 4:
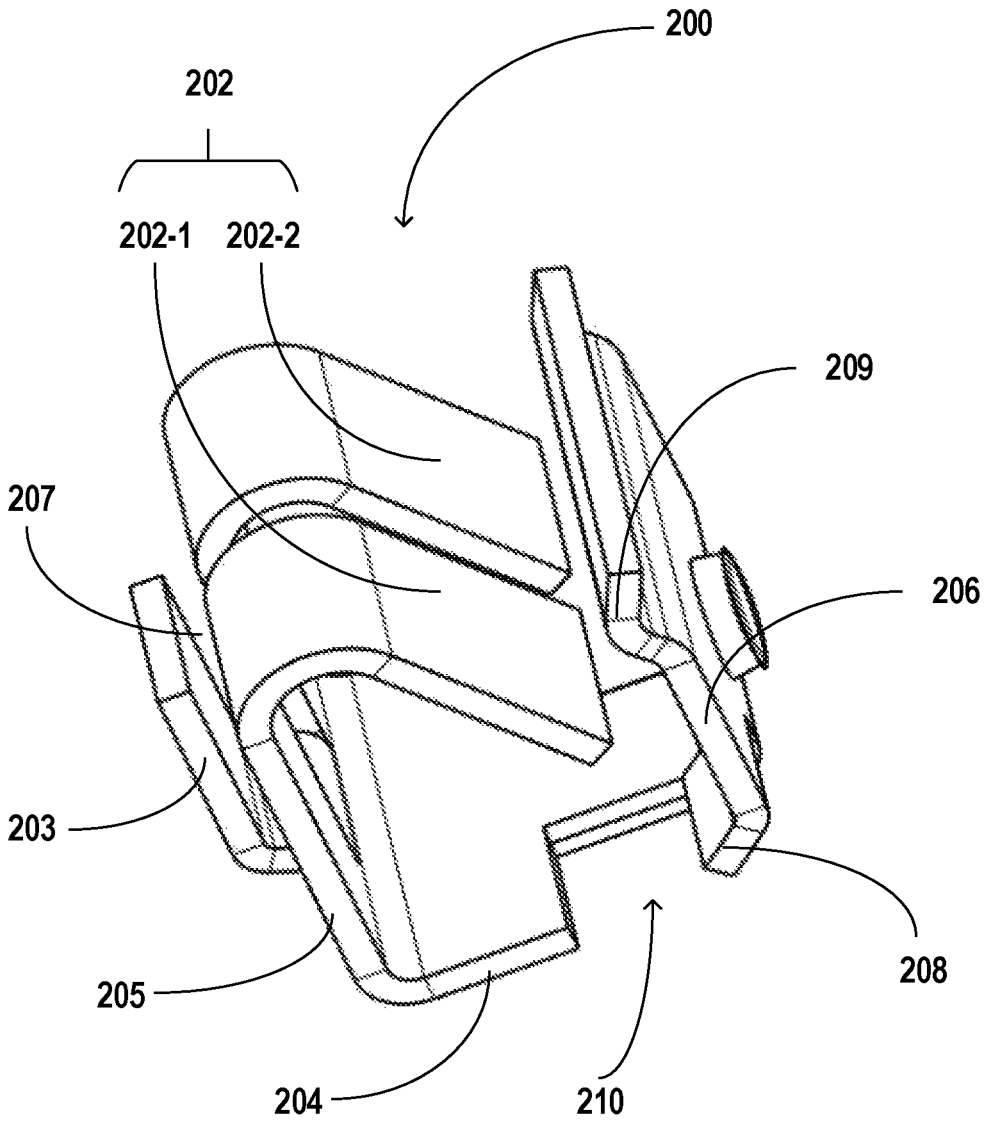
FIG. 4 illustrates a perspective view of a second terminal of a terminal assembly according to embodiments of the present disclosure.

In some embodiments, for example, referring to FIG. 4, the body 201 of the second terminal 200 may include a connection board 204. In particular, an end of the connection board 204 may be provided with a first arm 205, while the other end is provided with a second arm 206. The first arm 205 and the second arm 206 extend substantially in parallel with each other along a direction substantially perpendicular to the connection board 204. Hence, the first arm 205 and the second arm 206 disposed on the body 201 may cooperate with the clamping arm 202, and thus the wire is secured therebetween.

It should be noted that the term "substantially" used herein refers to that the modified may tolerate a small deviation. For example, "substantially perpendicular" for two objects refers to that the two objects contain an angle of 90 degrees, allowing a sufficiently small angle deviation (less than a predetermined tolerance threshold) according to the specific production technology or technical condition.

Continuing to refer to FIG. 4, in some embodiments, the hook 203 may be disposed on the first arm 205. As such, the first terminal 100 is connected onto the first arm 205 of the second terminal 200, thereby forming the terminal assembly 10 of the present disclosure.

In some embodiments, a gap 207 may be formed between the hook 203 and the first arm 205. Hence, the second wall 105 of the first terminal 100 can be inserted into the gap 207, thereby achieving the connection between the first terminal 100 and the second terminal 200.

Alternatively, in some other embodiments, the hook 203 may be configured in a form of elastic clip. As such, in the state that the first terminal 100 is separated from the second terminal 200, the hook 203 in the form of elastic clip contacts with the first arm 205; and in the state that the first terminal 100 is combined with the second terminal 200, the hook 203 in the form of elastic clip opens in a certain angle, to clamp and secure the first terminal 100 onto the second terminal 200.

For the connection between the clamping arm 202 and the body 201, the present disclosure provides the following optional embodiments. In some embodiments, the clamping arm 202 may be connected with the first arm 205. In addition, the second arm 206 may be provided thereon with curved portions for cooperating with the clamping arm 202 for clamping the wire. For example, in FIG. 4, a curved portion 208 is disposed at a position on the second arm 206 adjacent the connection board 204, and a curved portion 209 is disposed at a position on the second arm 206 away from the connection board 204. Accordingly, curved portions are provided on the second arm 206 to cooperate with the clamping arm 202, thereby implementing clamping and securing of the wire.

It would be appreciated that the curved portions according to the present disclosure are not confined to the forms as shown in FIG. 4. According to needs, one or more curved portions in different forms may be provided on the second arm 206, so long as the curved portions can cooperate with the clamping arm 202 to clamp and secure the wire.

Alternatively, in some other embodiments, the clamping arm 202 may be connected with the second arm 206. In those embodiments, the first arm 205 may be provided thereon with curved portions for cooperating with the clamping arm 202 to clamp the wire. For example, a curved portion 208 is disposed at a position on the first arm 205 adjacent the connection board 204, and a curved portion 209 is disposed at a position on the first arm 205 away from the connection board 204. Hence, curved portions are provided on the first arm 205 to cooperate with the clamping arm 202, thereby implementing clamping and securing of the wire. It would also be appreciated that, according to needs, one or more curved portions in different forms may be provided on the first arm 205, so long as the curved portions can cooperate with the clamping arm 202 to clamp and secure the wire.

In some embodiments, the connection board 204 may be provided thereon with a recess 210 for allowing the wire to pass through, as seen from FIG. 4. Therefore, the wire can pass through the recess 210, to facilitate the connection between the wire and the second terminal 200.

In some embodiments, the clamping arm 210 may be a resilient arm. Consequently, the cooperation between the resilient clamping arm 202 and the body 201 of the second terminal 200 is much closer, to clamp and secure the wire more reliably.

In some embodiments, the clamping arm 202 may be split into two clamping arms 202-1, 202-2 extending in parallel with each other. In particular, the two clamping arms 202-1, 202-2 are of substantially the same shape and substantially the same size. In addition, the two clamping arms 202-1, 202-2 may be both connected with the first arm 205 or the second arm 206. By splitting a single clamping arm 202 into two, the two clamping arms 202 may generate different deformation to clamp adaptively two wires of different thickness.

In some embodiments, the second terminal 200 may include a current-carrying component. As such, the second terminal 200 may have further following functions: supporting and securing the first terminal, connecting the wire, and carrying current, so as to make the entire structure of the terminal assembly more compact.

Referring to FIG. 2, the connection between the terminal assembly 10 according to the present disclosure and the wire will be described exemplarily. It would be appreciated that the example description does not formulate any limitation to the structure and the operation mode of the present disclosure.

First, the insulating cover at the end of the multi-core wire may be peeled off to expose the multi-core metal wire. Then, the multi-core metal wire is disposed in the cavity 103 of the first terminal 100. Subsequently, the screw 102 is tightened, to clamp the multi-core metal wire between the end face of the screw 102 and the second wall 105 of the terminal seat 101, to complete clamping and securing of the multi-core wire.

The insulating cover at the end of the single core wire is peeled off to expose the single core metal wire. Then, the single core metal wire passes through the recess 210 on the connection board 204 of the second terminal 200. Subsequently, the single core metal wire is disposed between the clamping arm 202 and the curved portions 208, 209 disposed on the second arm 206, to complete clamping and securing of the single core wire.

Through the terminal assembly provided according to the embodiments of the present disclosure, two different types of terminals (i.e., the threaded terminal and the unthreaded terminal) are combined in the same terminal assembly. Due to its advantages of wide application and the capability of satisfying criterion and standards in different countries and areas, the terminal assembly broadens the application of the product. In the meantime, the costs in relation to molds is reduced Although the claims of the present application are drafted for a particular combination of features, it would be appreciated that the scope of the present disclosure may also cover any novel feature or any novel combination of features explicitly or implicitly disclosed therein or generated therefrom, no matter whether it relates to the same solution claimed in any of the current claims. It is reminded that new claims may be formulated based on these features and/or a combination of these features in the examination procedure of the present application or any application further derived therefrom.

I claim:

1. A terminal assembly for an electrical device, comprising:

a first terminal comprising a terminal seat and a screw in a threaded connection with the terminal seat, a cavity for receiving a wire being formed in the terminal seat; and a second terminal, comprising:

a body provided with a hook thereon, wherein the first terminal is adapted to be connected with the second terminal via the hook; and a clamping arm with one end connected with the body and the other end being a free end adapted to cooperate with the body for clamping the wire.

2. The terminal assembly of claim 1, wherein the terminal seat of the first terminal comprises a first wall and a second wall opposite to each other, and wherein the first wall is provided with a threaded hole thereon for receiving the screw, and wherein the second wall is adapted to be connected with the second terminal via the hook of the second terminal.

3. The terminal assembly of claim 1, wherein the body of the second terminal comprises a connection board, with one end of the connection board provided with a first arm and the other end of the connection board provided with a second arm, the first arm and the second arm extending in parallel with each other along a direction perpendicular to the connection board.

4. The terminal assembly of claim 3, wherein the hook is provided on the first arm.

5. The terminal assembly of claim 4, wherein a gap for engaging the first terminal is formed between the hook and the first arm.

6. The terminal assembly of claim 3, wherein the clamping arm is connected with the first arm, and the second arm is provided with a curved portion thereon for cooperating with the clamping arm to clamp the wire.

7. The terminal assembly of claim 3, wherein the clamping arm is connected with the second arm, and the first arm is provided with a curved portion thereon for cooperating with the clamping arm to clamp the wire.

8. The terminal assembly of claim 3, wherein the connection board is provided with a recess thereon for allowing the wire to pass through.

9. The terminal assembly of claim 1, wherein the clamping arm is a resilient arm.

10. The terminal assembly of claim 1, wherein the clamping arm comprises two clamping arms extending in parallel with each other.

11. The terminal assembly of claim 1, wherein the second terminal comprises a current-carrying component.

12. An electrical device, comprising a terminal assembly of claim 1.

* * * * *